United States Patent [19]

Jin

[11] Patent Number: 4,904,971

[45] Date of Patent: Feb. 27, 1990

[54] SUPERCONDUCTIVE ELECTROMAGNET

[75] Inventor: Korda K. Jin, Brea, Calif.

[73] Assignee: Rockwell International Corporation, El Segundo, Calif.

[21] Appl. No.: 153,740

[22] Filed: Feb. 8, 1988

[51] Int. Cl.[4] ..... H01F 7/22; H01B 12/00

[52] U.S. Cl. ..... 335/216; 335/222; 505/1

[58] Field of Search ..... 335/216, 222, 223, 224, 335/299

[56] References Cited

U.S. PATENT DOCUMENTS

| | | | |
|---|---|---|---|
| 3,233,155 | 2/1966 | Atherton | 335/216 |
| 3,467,925 | 9/1969 | Masuda | 335/222 X |
| 3,629,753 | 12/1971 | Kawabe et al. | 335/216 |
| 4,048,602 | 9/1977 | Diamantides | 335/222 |

*Primary Examiner*—George Harris

*Attorney, Agent, or Firm*—H. Frederick Hamann; George A. Montanye; James F. Kirk

[57] ABSTRACT

A superconducting electromagnet comprising an outer core having an aperture; an inner core having a periphery characterized for complementary insertion into the outer core aperture leaving a uniform gap therebetween and a frame means for coupling the outer and inner cores into a fixed position relation. A magnetizing means, such as a coil on the inner core develops an initial flux field. The flux field passes through the inner core, the first gap, the outer core, across the second gap to the inner core in response to excitation of the magnetizing means. The outer and inner cores are coated on all surfaces except opposing inner and outer core gap surfaces with superconductive material. The superconductive material is applied to the outer and inner cores at regions selected to pass induced magnetizing current. The induced magnetizing current circulating via closed current paths within the superconductive material to support the flux free of energy loss on termination of excitation of the magnetizing means. A force coil is shaped for insertion in and free movement within the gap between the inner and outer coils. The force coil is coupled to apply a force to a workpiece in response to application of a control current to the force coil in the presence of the flux field in the first and second gaps.

9 Claims, 5 Drawing Sheets

SUPERCONDUCTIVE ELECTROMAGNET

BACKGROUND OF THE INVENTION

1. Field of the Invention

This invention relates to the field of electromagnetic devices and more particularly to the field of instrument devices that require a constant high-density low-leakage permanent magnetic field and a force coil for operation such as dc meter movements, linear motors and some solenoids.

2. Description of Prior Art

Electromagnetic instruments such as dc meter movements typically employ a force coil supported on a bearing system and positioned in a magnetic field typically between the poles of a permanent magnet. Electromagnets are used in the prior art in place of the permanent magnets to provide a field having a flux density magnitude greater than that obtainable with permanent magnets. A field provided by an electro magnet requires a constant expenditure of electrical power to maintain the field.

Leakage magnetic flux, which is undesirable is unavoidably present with all these magnets, permanent as well as electromagnet.

SUMMARY OF INVENTION

This invention provides an electro magnet in the form of a core assembly having an inner and outer core for generating and supporting a constant high-density magnetic field without the continuous expenditure of excitation power at a temperature below the critical temperature of a superconductive coating used on the inner and outer cores and with very little leakage flux.

A magnetizing coil is initially excited to provide the required flux density. The temperature of the invention is then lowered to a level below the critical temperature of the superconductive coating and the excitation of the magnetizing coil is then interrupted. Current is induced to circulate in the superconductive coating on the surface of the inventions core assembly thereby preserving the flux field density at a level substantially equal to the initial level established by the excited magnetizing coil. A force coil is supported in the magnetic flux gap and provides a force to a workpiece or sensor in response to excitation of the force coil by a control current from a control current source.

PREFERRED EMBODIMENT

Figure 1:
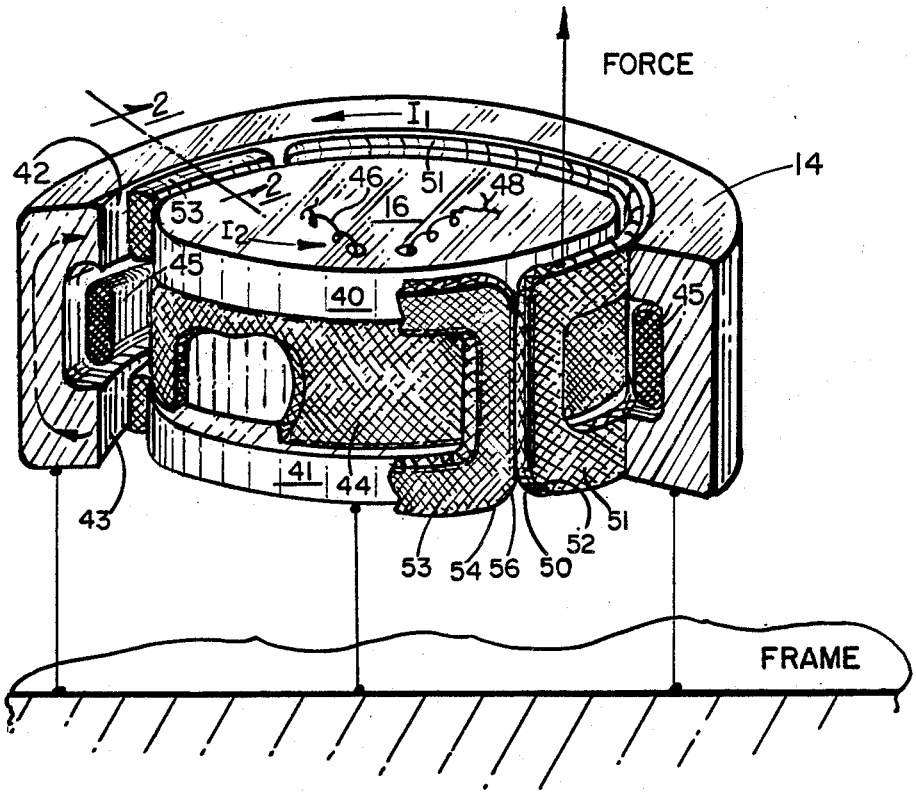
FIG. 1 is a perspective view of the invention superconductive electromagnet.

FIG. 1 depicts a partially sectioned view of the invention superconducting electromagnet. The invention has an outer core such as outer ring 14, and an inner core such as spool 16.

The outer core is shown having a circular aperture for receiving the inner core and the force coils 51, 53. The inner core is shown having a periphery characterized for complementary insertion into said outer core aperture leaving a uniform gap therebetween. A frame means couples the outer and inner cores into a fixed position relation as shown in FIG. 1.

Magnetizing coil 44 represents a magnetizing means for developing a flux field having a closed flux path through the core assembly 16, 14. The inner core is designed to direct the flux field axially through the inner core.

Figure 2:
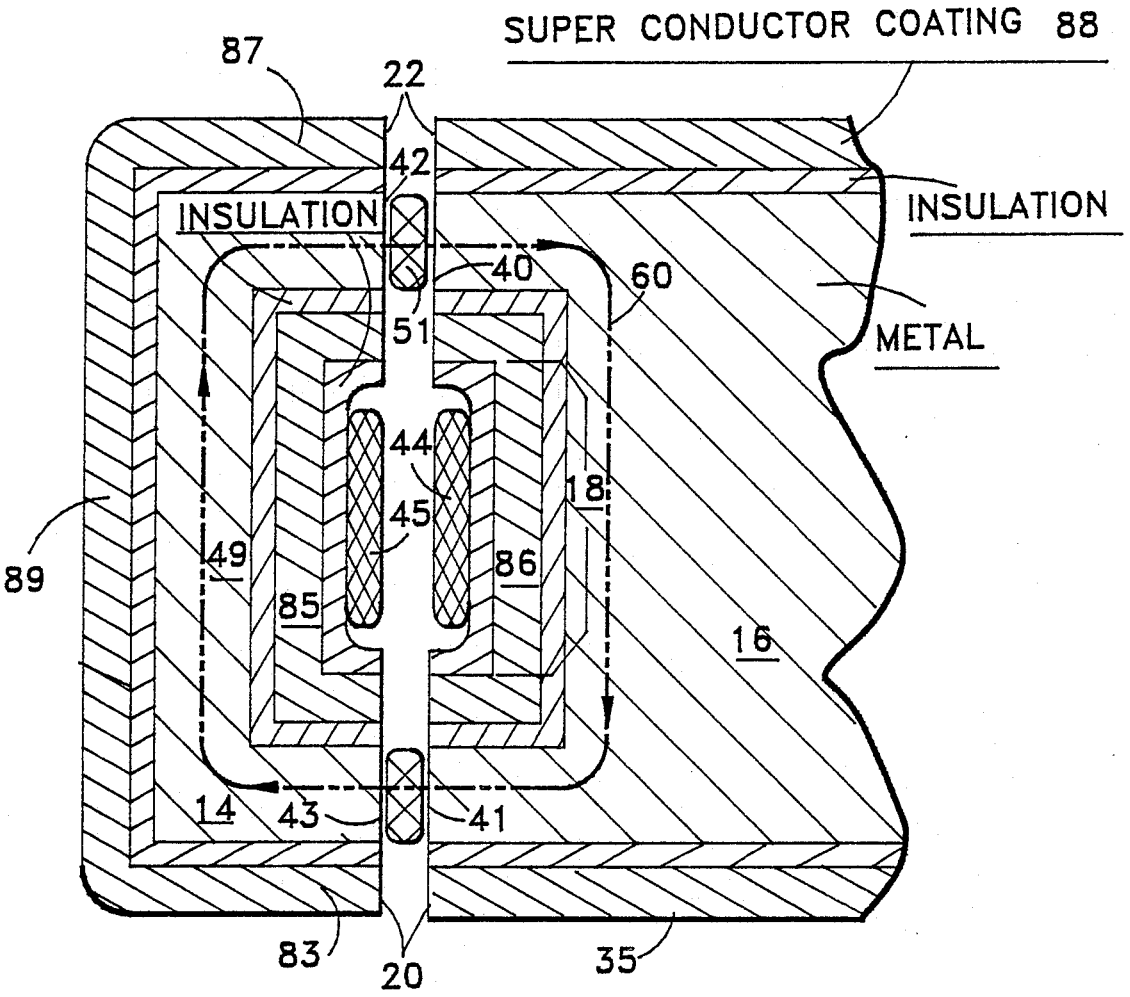
FIG. 2 is a sectional view of the invention superconductive electromagnet taken along line 2—2 of FIG. 1.

Referring to FIG. 2, the inner core cross section is shaped to direct the flux from the inner core across a first magnetic flux gap 20 to the outer core, i.e. outer ring 14. The outer core is shaped to direct the flux through the outer core to second magnetic flux gap 22 to reenter the inner core to complete the flux path.

The outer and inner cores 14, 16 are coated with superconductive material. Regions 83, 84, 85, 86, 87, 88, and 89 represent a sectional view of the coated surfaces. The superconductive material is applied to the outer and inner cores at regions selected to pass induced magnetizing current. In the sectional view of FIG. 2, the induced magnetizing currents would be moving directly into or out of the plane of the drawing.

Figure 3:
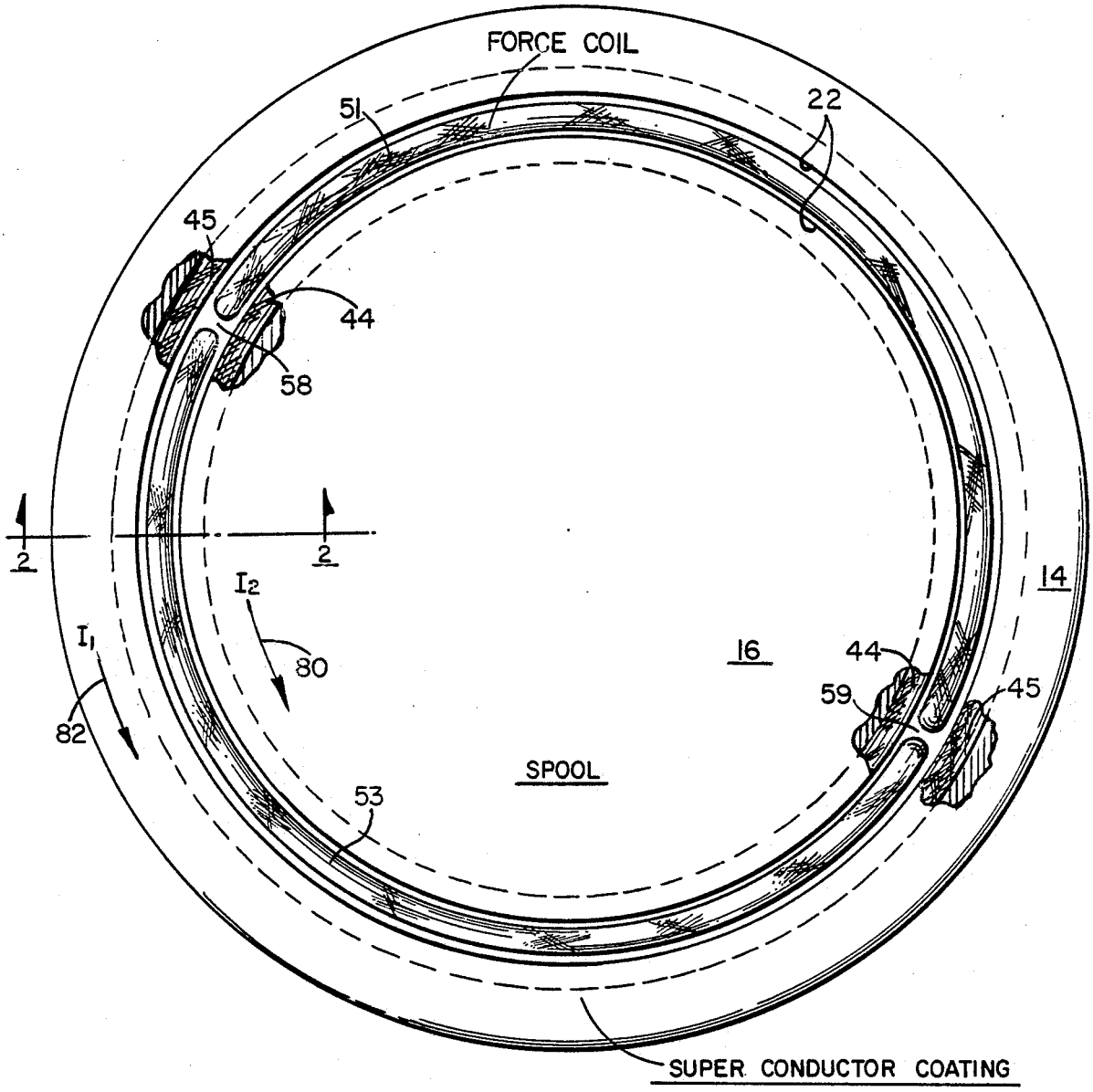
FIG. 3 is a top plan view of the superconductive electromagnet of FIG. 1.

FIG. 3 depicts the induced magnetizing currents 80, 82 circulating in a circular pattern on the surface of the outer ring. The current is induced by interruption of excitation current in the magnetizing coil 44. The induced currents circulate in closed current paths within the superconductive material to support the flux in the core and the flux traversing the gaps such as second gap 22. Since current circulation is maintained in the superconductive coating without energy loss, the current remains at its initial amplitude, and thereby preserves the flux amplitude within the inner and outer core and in the first and second air gaps.

A force coil is represented by coils 51 and 53 in FIG. 3. Force coils 51 and 53 are also shown in FIG. 1. Each of these force coils has a first and second lead (not shown) for connection to a control current source (not shown). The force coil is shaped for insertion in and free movement within the gaps 20, 22 between the inner and outer coils.

Figure 4:
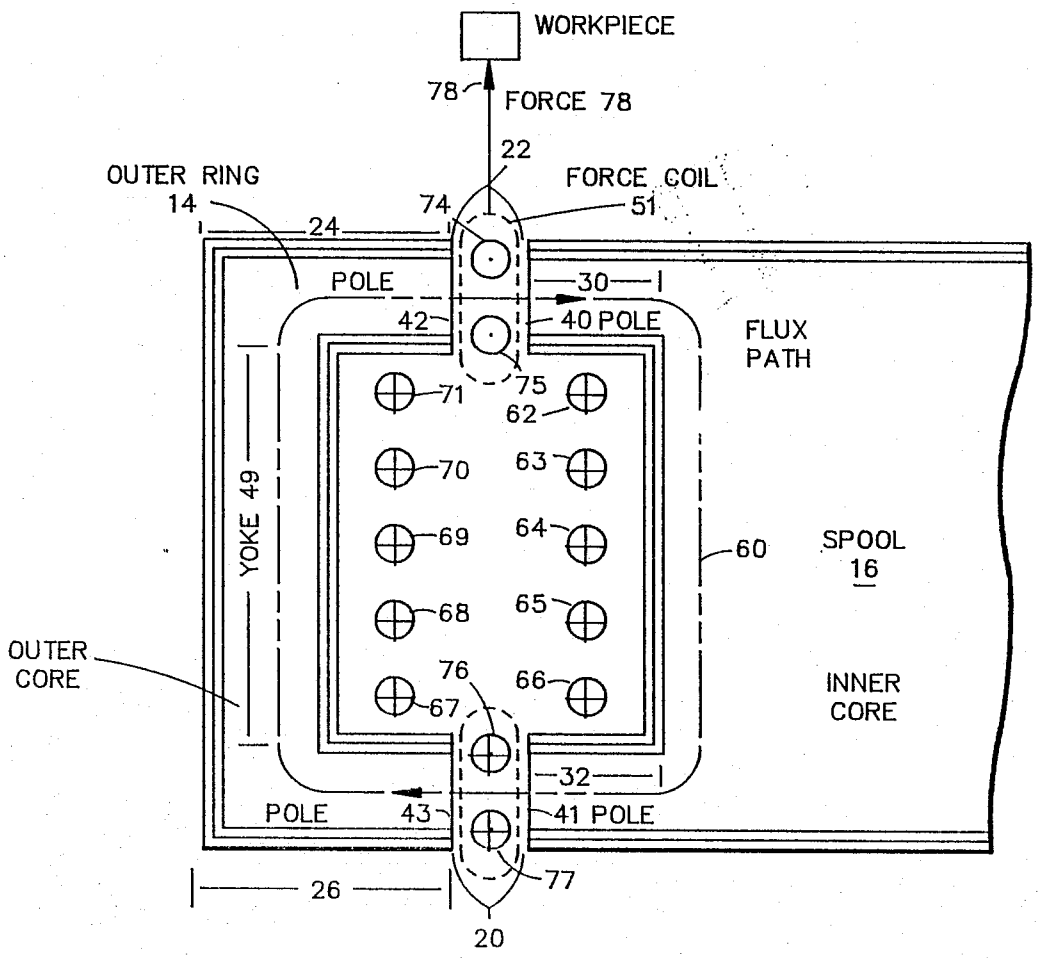
FIG. 4 is a schematic drawing depicting the direction of the flux field and the direction of force at the force coil resulting from control currents entering and leaving the plane of the drawing and interacting with the flux field.

FIG. 4 schematically depicts currents circulating in a first magnetizing coil in which conductors are represented by circles 62–66 in spool 16 and in a second magnetizing coil in the outer ring 14 in which conductors are represented by circles 67–71. The plus (+) symbols within the circles is a convention adopted to indicate that the assumed direction of magnetizing current flow in the respective conductors prior to interruption is into the plane of the conductors.

The force coil 51 is represented in FIG. 4 by conductors 74, 75 and by conductors 76, 77. The force coil is schematically shown as applying a force to a workpiece in response to application of a control current to the force coil in the presence of the said field in the first and second gaps. It should be realized that the currents shown to exist in the magnetizing coil are not present after interruption of the magnetizing currents. Currents induced in the superconductive layers preserve the internal field and the field across the gaps that is shown interacting with the current flow in the force coil to produce the indicated force vector applied to the work piece. Force coil conductors 74, 75 are shown with centered dots, a convention adopted to indicate that control current is leaving the plane of the paper. The reverse is true for conductors 76, 77.

The force vector is reversed by changing the direction of current flow in the force coil, or in the alternative by initially reversing the direction of the flux field by changing the initial direction of the magnetizing current in the magnetizing coils.

The outer core is shaped to form an outer cylindrical ring having a channel on its inner periphery. As shown in FIG. 4, the ring is further characterized to have a uniform "C-shaped" cross-section. The "C" shape has a top pole segment 24, having a top pole face 42, a bottom pole segment 26 having a bottom pole face 43, and a uniform yoke section 49 separating the top and bottom poles by a distance equal to the length of said yoke section. The top and bottom pole faces form the cylindrical boundary of the outer core aperture.

The inner core 16 is shaped to form a spool. The spool is shown in FIG. 4 as having a top and bottom flange 30, 32. The spool flanges are separated by a cylindrical post having a length substantially equivalent to said outer ring yoke 49. Each respective spool flange has a respective pole face. Each respective spool pole face is positioned within the outer ring aperture to oppose a corresponding ring pole face. The gap between each spool pole face and the opposing ring pole face is typically uniform to permit insertion and free vertical movement of the force coil assembly 51, 53. In the alternative, the gap can be non-uniform and shaped to produce a desired flux pattern in the gap.

The magnetizing coil 44 is an inner core coil positioned on said inner core cylindrical post between said inner core top and bottom flanges. The magnetizing coil winding is a single winding that is concentric with the axis of the spool. The magnetizing coil is wound on the spool as a continuous coil. The magnetizing coil 44 is wound on the spool to a height or diameter not exceeding the diameter of said inner core top and bottom flanges. After winding the magnetizing coil on the spool or inner core to the desired height, the surface of the spool is taped or coated to form a smooth cylinder for insertion into the outer core aperture. The surface of the inner core is finished to be smooth to permit unobstructed movement of the force coil assembly 51, 53 in the gap.

As shown in FIG. 2, in an alternative embodiment, the magnetizing coil is further characterized to have a second segment or outer core magnetizing coil 45 positioned against inner periphery of the yoke 49 in the space between said outer ring top flange 24 and said outer ring bottom flange 26. The outer core magnetizing coil has an inner diameter not less than the inner diameter of said outer core top and bottom pole faces. The inner surface of the outer core is also finished to be a smooth cylinder to permit free movement of force coils 51, 53.

The spool and ring are made from ferromagnetic material. The outer ring 14 and the spool 16 of the invention electromagnet are coated with superconducting material except where the circumference of the spool opposes the inner circumference of the ring. The opposing surfaces, 40, 41, 42, 43 are not coated with superconducting material.

Referring to FIG. 2, The superconductor material applied to the surface of the inner and outer cores is typically an oxide of barium, copper and one or more rare earth elements selected for its high critical current and magnetic field property, or in the alternative, conventional low temperature superconducting material with operation of the invention restricted to operation at temperatures below the critical temperature of the material used. The superconductive coating is applied using processes such as vacuum deposition, sputtering or ion implantation.

Referring again to FIG. 1, current is applied through the magnetizing coil 44 via the magnetizing leads shown exiting the top of the spool to magnetize the spool. The flux lines produced by the excited magnetizing coil 44 pass through the spool top pole face 40, jump the air gap to ring top pole face 42, then passes down through the ring yoke 49 to exit the ring 14 at ring bottom pole face 43. The flux lines jump the lower gap 20 to enter the spool 16 at spool bottom pole face 41 to complete the flux path through the spool 16.

OPERATION

The magnetizing current is first applied to the magnetizing coil at a temperature above the critical temperature. The invention solenoid is then cooled to a temperature below the critical temperature for the superconductor material selected for use. The current through coil 44 is interrupted by disconnecting lead 46 and 48 from the current source (not shown). The flux in the gap is trapped by the superconducting material. The trapped flux in the gap and in the respective spool and ring paths form a permanent magnet for as long as the temperature of the unit is maintained below the critical temperature. The field thus produced is constant and can be established with a magnitude above that obtainable with conventional permanent magnets. Another advantage is that flux can not leak from any surfaces coated with superconductive material. The invention solenoid magnet will only leak small levels of fringing flux at the gaps between the spool and the ring.

Interrupting the current in magnetizing coil 44 eliminates the ampere turns or magneto-motive force supporting the established flux. The ampere turns lost by interrupting the magnetizing current in the magnetizing coil 44 are replaced by current that starts in the superconducting material on both the spool and the ring and circulates through the superconducting material. The interruption of current in the magnetizing current in the magnetizing coil is achieved with high speed switching to minimize the loss of energy stored in the flux.

The purpose of the hollow area on the inner surface of the ring is to create the poles thereby directing and focusing the flux lines produced. An alternative purpose is to create a receiving area for an additional magnetizing coil. The shape of the cross section of the outer ring 14 is not restricted to any particular shape. The cross section shown in FIG. 4 depicts top and bottom poles separated by yoke 49. The cross section of the yoke and the pole pieces should be of sufficient thickness to prevent saturation based on the designed MMF established by the spool coil 44, its turns count and the magnetizing current magnitude proceeding its interruption.

The width of the top pole face is characterized in FIG. 2 as being equal to the width of the bottom pole face. The width of the top and bottom pole faces are shown to be equal to the widths of the spool top and bottom pole faces. This arrangement is believed to be the preferred embodiment. However, other arrangements are believed possible such as a conical arrangement and an arrangement in which the ring yoke is not recessed.

FIGS. 1 and 2 show the magnetizing coil 44 to be positioned in the recess of the spool 16. As an alternative embodiment, the magnetizing coil 44 could be positioned in the recess of the outer ring 14 or split to form two magnetizing coils, one being in the recess of spool 16 and the other section being within the recess of the outer ring 14.

The magnetizing coil, or coils, is imbedded within the recess using a conventional structural adhesive such as baked shellac, rubber adhesive or epoxy depending on the design requirements.

Force coils 51, 53 are coupled together to provide a symmetrical structure within the gap between the outer ring 14 and the spool 16. The force coils are free to move linearly up or down within the gap. The force coils 51, 53 are excited by a control current via lead pairs 50, 52 and 54, 56 respectively. The coils are typically connected in series.

FIG. 2 shows force coils 51 positioned within the gaps 20, 22. FIG. 3 shows force coils 51, 53 concentrically positioned within the gap and free to move in or out of the plane of the drawing. Two force coils are used to achieve a symmetrical force. A single force coil would have a single interruption in its circumference. Since no force would be produced at interruptions, such as 58, 59, or application of a control current would result in a torque as well as a force being developed for the single force coil case. Symmetry in the number and placement of interruptions eliminates or reduces the problems associated with unwanted torques applied to the force coil. The gap in which the force coil is free to move is represented in FIG. 2 by gaps 20 and 22. FIG. 3 depicts the top gap since it is a top view.

Figure 5:
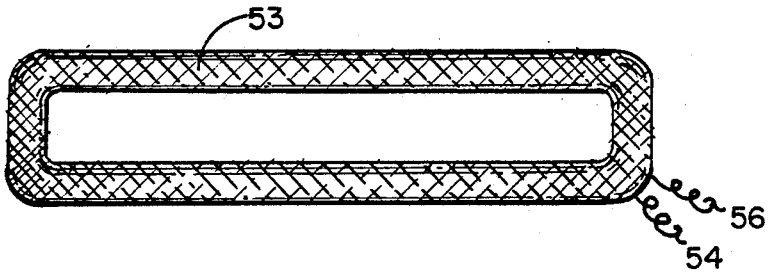
FIG. 5 is a plan view of a force coil segment after formation on a flat bobbin.
Figure 6:
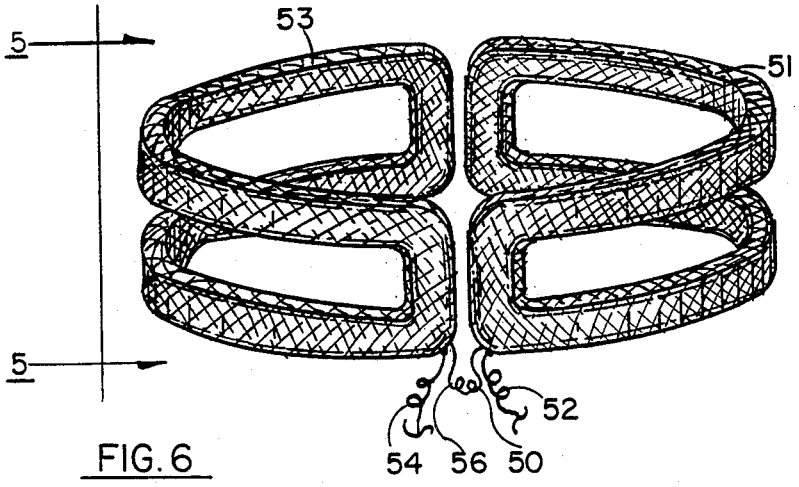
FIG. 6 is a perspective view of a symmetrical pair of force coils connected in series and having first and second leads for connection to a control current source.

The force coils 51, 53 are initially formed on a bobbin as shown in FIG. 5 as a flat coil and then shaped on mandrel or form and made rigid by a conventional means such as impregnation while being held within a form characterized to convey a cylindrical shape of the gap less appropriate clearances to the force coil.

FIG. 4 shows the direction that flux lines 60 take in response to initial magnetizing currents in the magnetizing coil. The conductors in the magnetizing coil are represented by circles 62, 63, 64, 65 and 66. Current flow into the plane of the drawing is designated by a plus (+) sign within the respective circle. As shown, pole face 40 is a south pole, 41 is a north pole, 43 is a south pole and 42 is a north pole. Conductors within an alternative magnetizing coil within the recess of the outer ring by circles 67, 68, 69, 70 and 71. Currents within the alternative magnetizing coil are also shown entering the plane of the cross-section.

Conductors within the force coil of FIG. 4 are represented by circles 74, 75 and by coils 76, 77. The conductors are coated with a insulative coating suitable for low temperature operation. Currents within the force coil conductors is designated as leaving the plane of the cross-section by the (.) within circles 74 and 75. Currents entering the plane of the cross-section are designated by the period or dot (+) such as those within circles 76 and 77.

The force produced by currents of the polarity shown in FIG. 4 is in an upward direction as illustrated by vector 78. The direction of the force produced is established using the left hand rule. The left hand rule provides that if the index finger is pointed in the direction of flux in a field of flux and the middle finger is pointed in the direction of current within a conductor, then the thumb points in the direction of force applied by the flux field to the conductor carrying the current. The thumb, the index finger, and the middle finger are at right angle to each other.

The force applied to or by the force coil to a workpiece or instrument element coupled to the force coil depends on the flux density of the field, the number of turns in the force coil and the amplitude of the control current in the force coil. Force can therefore be applied to the force coil before or after interruption of the magnetizing current in the magnetizing coil 44.

Interrupting the magnetizing current designated by the drawing of FIG. 4 while preserving the sense or polarity of the flux supported by the magnetizing current produces currents in the superconducting coating represented by vectors 80 and 82 having a rotational direction as shown in the top view of FIG. 3.

PRESET SCALE FACTOR

It is advantageous to be able to design electromagnetic instruments, such as accelerometers, having a predetermined constant scale factor (force per unit current).

To produce a predetermined constant scale factor for a given control current through the force coil 51, 53, an initial control current is established in the force coil. The current in the magnetizing coil is then increased or decreased, as required, while measuring the force produced by the force coil on a work piece until the predetermined required force is obtained. While holding the magnetizing current constant, the device temperature is lowered to be below the critical temperature for the superconductive coating that is used. The magnetizing current is then interrupted to produce the predetermined circulating current in the superconductive coating required to maintain the force on the work piece.

I claim:

1. A superconducting electromagnet comprising:

an outer core having an aperture;

an inner core having a periphery characterized for complementary insertion into said outer core aperture leaving a uniform gap therebetween;

a frame means for coupling said outer and inner cores into a fixed position relation;

a magnetizing means for developing a flux field having a closed flux path passing through a inner core, said first gap, said outer core, across a second gap to said inner core in response to excitation of said magnetizing means;

said outer and inner cores being coated on all surfaces except opposing inner and outer core gap surfaces with superconductive material;

said superconductive material being applied to said outer and inner cores at regions selected to pass induced magnetizing current, said induced magnetizing current circulating via closed current paths within said superconductive material to support said flux substantially free of energy loss on termination of excitation of said magnetizing means; and a force coil for connection to a control current source, said force coil being shaped for insertion in and free movement within the gap between said opposing inner and outer core gap surfaces, said force coil being coupled to apply a force to a workpiece in response to application of a control current to said force coil in the presence of said flux field in said first and second gaps.

2. The superconducting solenoid of claim 1 wherein said magnetizing means is an inner core coil positioned on a inner core cylindrical post between inner core top and bottom flanges.

3. The superconducting electromagnet of claim 1 wherein said magnetizing means is further characterized to have an outer core coil positioned against the yokes inner periphery in the space between an outer ring top flange and said outer ring bottom flange.

4. A superconducting electromagnet comprising:

an outer core having an aperture;

an inner core having a periphery characterized for complementary insertion into said outer core aperture leaving a uniform gap therebetween;

a frame means for coupling said outer and inner cores into a fixed position relation;

a magnetizing means for developing a flux field having a closed flux path, said flux being characterized to pass axially through said inner core, said inner core cross section being shaped to direct said flux from said inner core across a first gap to said outer core, said outer core being shaped to direct said flux through said outer core to a second gap to reenter said inner core to complete the flux path;

said outer and inner cores being coated with superconductive material, said superconductive material being rendered superconductive at temperatures below a critical temperature, said superconductive material being applied to said outer and inner cores at regions selected to pass induced magnetizing current, said induced magnetizing current circulating via closed current paths within said superconductive material to support said flux substantially free of energy loss on termination of excitation to said magnetizing means, a force coil having first and second leads for connection to a control current source, said force coil being shaped for insertion in and free movement within the gaps between said inner and outer coils, said force coil being coupled to apply a force to a workpiece in response to application of a control current to said force coil in the presence of said flux field in said first and second gaps.

5. The superconducting electromagnet of claim 4 wherein said outer core is shaped to form an outer cylindrical ring, said ring being further characterized to have a uniform "C-shaped" cross section, said "C" shape having a top pole segment having a top pole face, a bottom pole segment having a bottom pole face, and a uniform yoke section separating said top and bottom poles by a distance equal to the length of said yoke section, said top and bottom pole faces forming the cylindrical boundary of said outer core aperture; and wherein, said inner core is shaped to form a spool, said spool having a top and bottom flange, each respective spool flange being separated by a cylindrical post having a length substantially equivalent to said outer ring yoke; each respective spool flange having a respective pole face, each respective spool pole face being positioned within said outer ring aperture to oppose a corresponding ring pole face with a respective uniform gap therebetween.

6. The superconducting electromagnet of claim 5 wherein said magnetizing coil is an inner core coil positioned on said inner core cylindrical post between said inner core top and bottom flanges, said magnetizing coil having a diameter not exceeding the diameter of said inner core top and bottom flanges.

7. The superconducting electromagnet of claim 5 wherein said magnetizing coil is further characterized to have an outer core coil positioned against the yokes inner periphery in the space between said outer ring top flange and said outer ring bottom flange, said outer core magnetizing coil having an inner diameter not less than the inner diameter of said outer core top and bottom pole faces.

8. The superconducting electromagnet of claim 5 wherein said superconductive coating applied to said inner and outer cores is applied over a layer of insulative material.

9. A method for adjusting the field of a superconducting electromagnet to have a preset scale factor for use in constructing instruments comprising the steps of:

a. sourcing a predetermined control current into a control coil positioned in at least one flux gap between the first and second pole of a core, having a superconductor coating;

b. sourcing and adjusting the current through a magnetizing coil positioned on the core to produce a magnetic field in said flux gap to enable the force coil to produce a predetermined force against a workpiece;

c. cooling the core to a temperature below the critical temperature of the superconducting material coated thereon; and d. interrupting the magnetizing current.

* * * * *